US010180093B2

(12) United States Patent
Rusher et al.

(10) Patent No.: US 10,180,093 B2
(45) Date of Patent: Jan. 15, 2019

(54) SELECTIVELY TUNABLE EXHAUST NOISE ATTENUATION DEVICE

(71) Applicant: GM GLOBAL TECHNOLOGY OPERATIONS LLC, Detroit, MI (US)

(72) Inventors: Charles D. Rusher, Brighton, MI (US); Roger C. Barlow, Jr., Brighton, MI (US); Scott M. Reilly, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 16 days.

(21) Appl. No.: 15/402,880

(22) Filed: Jan. 10, 2017

(65) Prior Publication Data

US 2017/0298793 A1 Oct. 19, 2017

Related U.S. Application Data

(60) Provisional application No. 62/321,815, filed on Apr. 13, 2016.

(51) Int. Cl.
*F01N 1/16* (2006.01)
*F01N 1/00* (2006.01)

(52) U.S. Cl.
CPC ..... *F01N 1/165* (2013.01); *F01N 1/006* (2013.01); *F01N 1/163* (2013.01); *F01N 1/166* (2013.01)

(58) Field of Classification Search
CPC . F01N 1/003; F01N 1/006; F01N 1/08; F01N 1/163; F01N 1/165; F01N 1/166
USPC ..... 60/312–314
See application file for complete search history.

(56) References Cited

U.S. PATENT DOCUMENTS

| | | | | |
|---|---|---|---|---|
| 5,003,781 | A * | 4/1991 | Shibata | F01N 1/166 181/226 |
| 6,189,650 | B1 * | 2/2001 | Inuzuka | F01N 1/089 181/254 |
| 6,644,437 | B1 * | 11/2003 | Hayman | F01N 1/02 181/237 |
| 2006/0000205 | A1 * | 1/2006 | Bozmoski | F01N 1/166 60/324 |
| 2006/0150620 | A1 * | 7/2006 | Nagai | F01N 1/166 60/324 |
| 2010/0146957 | A1 * | 6/2010 | Ambrosino | F01N 1/163 60/324 |
| 2011/0061969 | A1 * | 3/2011 | Hill | F01N 1/006 181/239 |

* cited by examiner

*Primary Examiner* — Phutthiwat Wongwian
*Assistant Examiner* — Diem Tran
(74) *Attorney, Agent, or Firm* — Cantor Colburn LLP

(57) ABSTRACT

A selectively tunable exhaust noise attenuation device includes a body having an outer surface and an inner surface that defines an exhaust volume. An inlet is coupled to the body and fluidically connected to the exhaust volume. A first outlet is coupled to the body and fluidically connected to the inlet and selectively fluidically connected to the exhaust volume and a second outlet coupled to the body and fluidically connected to the exhaust volume. A first conduit including a primary exhaust gas flow path directly fluidically connects the inlet and the first outlet. A second conduit includes a first end and a second. The second conduit defines a secondary exhaust gas flow path. A valve is fluidically connected to one of the first and second conduits. The valve is arranged laterally off-set of the primary exhaust gas flow path.

20 Claims, 3 Drawing Sheets

SELECTIVELY TUNABLE EXHAUST NOISE ATTENUATION DEVICE

CROSS-REFERENCE TO RELATED APPLICATIONS

The present application claims priority to U.S. Provisional Application No. 62/321,815, filed on Apr. 13, 2016, the contents of which are incorporated by reference herein in their entirety.

INTRODUCTION

The subject field relates to the art of vehicles, and more particularly, a selectively tunable exhaust noise attenuation device for a vehicle.

Vehicles powered by internal combustion engines are often provided with an exhaust noise attenuation device or "muffler". The muffler reduces noise associated with combusting an air/fuel mixture in the internal combustion engine in order to meet governmental regulations. In the muffler, exhaust gas are typically directed through one or more baffles and/or sound attenuating material such as fiberglass. The use of a muffler represents a tradeoff between sound attenuation and performance. Back pressure in the exhaust created by the muffler reduces engine performance. Also, certain users enjoy engine sounds that may be attenuated by the muffler. The attenuated sounds may not be enjoyed during typical street driving, however, other driving experiences may benefit from higher noise, lower back pressure and/or a mixture thereof. Accordingly, it is desirable to provide an exhaust noise attenuation device that may be selectively tuned to meet driver needs and driving conditions/environments.

SUMMARY

In accordance with an exemplary embodiment, a selectively tunable exhaust noise attenuation device includes a body having an outer surface and an inner surface that defines an exhaust volume. An inlet is coupled to the body and fluidically connected to the exhaust volume. A first outlet is coupled to the body and fluidically connected to the inlet and selectively fluidically connected to the exhaust volume and a second outlet coupled to the body and fluidically connected to the exhaust volume. A first conduit including a primary exhaust gas flow path directly fluidically connects the inlet and the first outlet. A second conduit includes a first end fluidically exposed to the exhaust volume, and a second end fluidically connected to the second outlet. The second conduit defines a secondary exhaust gas flow path. A valve is fluidically connected to one of the first and second conduits. The valve is arranged laterally off-set of the primary exhaust gas flow path.

In addition to one or more of the features described herein or below, or as an alternative, further embodiments could include a branch conduit extending radially outwardly of the first conduit, the branch conduit including a cantilevered end portion, wherein the valve is arranged at the cantilevered end portion of the branch conduit within the exhaust volume.

In addition to one or more of the features described herein or below, or as an alternative, further embodiments could include wherein the valve includes a valve member shiftable between a closed configuration and an open configuration, the valve member including a biasing member resiliently biasing the valve member in the closed configuration.

In addition to one or more of the features described herein or below, or as an alternative, further embodiments could include wherein the biasing member releases at a predetermined exhaust gas pressure in the branch conduit allowing the valve member to shift toward the open configuration.

In addition to one or more of the features described herein or below, or as an alternative, further embodiments could include wherein the biasing member comprises a coil spring.

In addition to one or more of the features described herein or below, or as an alternative, further embodiments could include an opening formed in the first conduit downstream of the branch conduit.

In addition to one or more of the features described herein or below, or as an alternative, further embodiments could include an opening formed in the branch conduit upstream of the valve.

In addition to one or more of the features described herein or below, or as an alternative, further embodiments could include a plurality of perforations formed in the second conduit.

In addition to one or more of the features described herein or below, or as an alternative, further embodiments could include a selectively controllable valve arranged on the first outlet externally of the body.

In addition to one or more of the features described herein or below, or as an alternative, further embodiments could include wherein the valve is a mechanical valve.

According to another aspect of an exemplary embodiment, a motor vehicle includes a vehicle body, an internal combustion engine arranged within the vehicle body, and a selectively tunable exhaust noise attenuation device fluidically connected to the internal combustion engine. The selectively tunable exhaust noise attenuation device includes a body having an outer surface and an inner surface that defines an exhaust volume. An inlet is coupled to the body and fluidically connected to the exhaust volume and the internal combustion engine. A first outlet is coupled to the body and fluidically connected to the exhaust volume and a second outlet coupled to the body and fluidically connected to the exhaust volume. A first conduit includes a primary exhaust gas flow path directly fluidically connecting the inlet and the first outlet. A second conduit includes a first end fluidically exposed to the exhaust volume, and a second end fluidically connected to the second outlet. The second conduit includes a secondary exhaust gas flow path. A valve is fluidically connected to one of the first and second conduits, the valve being arranged laterally off-set of the corresponding one of the primary and secondary exhaust gas flow paths.

In addition to one or more of the features described herein or below, or as an alternative, further embodiments could include a branch conduit extending radially outwardly of the first conduit, the branch conduit including a cantilevered end portion, wherein the valve is arranged at the cantilevered end portion of the branch conduit within the exhaust volume.

In addition to one or more of the features described herein or below, or as an alternative, further embodiments could include wherein the valve includes a valve member shiftable between a closed configuration and an open configuration, the valve member including a biasing member resiliently biasing the valve member in the closed configuration.

In addition to one or more of the features described herein or below, or as an alternative, further embodiments could include wherein the biasing member releases at a predetermined exhaust gas pressure in the branch conduit allowing the valve member to shift toward the open configuration.

In addition to one or more of the features described herein or below, or as an alternative, further embodiments could include wherein the biasing member comprises a coil spring.

In addition to one or more of the features described herein or below, or as an alternative, further embodiments could include an opening formed in the first conduit downstream of the branch conduit.

In addition to one or more of the features described herein or below, or as an alternative, further embodiments could include an opening formed in the branch conduit upstream of the valve.

In addition to one or more of the features described herein or below, or as an alternative, further embodiments could include a plurality of perforations formed in the second conduit.

In addition to one or more of the features described herein or below, or as an alternative, further embodiments could include a selectively controllable valve arranged on the first outlet externally of the body.

According to yet another aspect of an exemplary embodiment, a method of operating a selectively tunable exhaust noise attenuation device includes delivering exhaust gas into a body of the selectively tunable exhaust noise attenuation device, operating the selectively tunable exhaust noise attenuation device in a first mode in which all of the exhaust gas pass through a first conduit uninterrupted through the body, operating the selectively tunable exhaust noise attenuation device in a second mode in which a portion of the exhaust gas pass from the first conduit into the body and enter a second conduit, and operating the selectively tunable exhaust noise attenuation device in a third mode, in which a portion of the exhaust gas pass through a valve off-set from the first conduit into the body and through the second conduit.

The above features and advantages and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description referring to the drawings in which.

DETAILED DESCRIPTION

Figure 1:
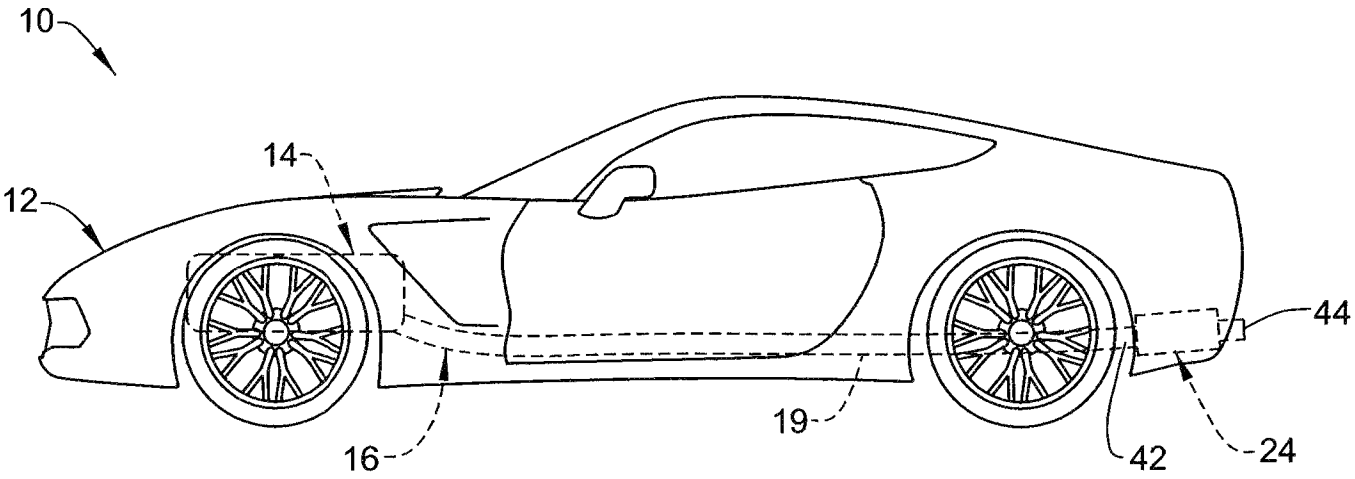
FIG. 1 is a schematic view of a vehicle including a selectively tunable exhaust noise attenuation device, in accordance with an aspect of an exemplary embodiment.

The following description is merely exemplary in nature and is not intended to limit the present disclosure, its application or uses. It should be understood that throughout the drawings, corresponding reference numerals indicate like or corresponding parts and features.

A motor vehicle, in accordance with an exemplary embodiment, is indicated generally at 10 in FIG. 1. Motor vehicle 10 includes a vehicle body 12 that houses, in part, an internal combustion engine 14. An exhaust system 16 is coupled to internal combustion engine 14. Exhaust system 16 includes an exhaust gas conduit or pipe 19 that fluidically connects internal combustion engine 14 with a selectively tunable exhaust noise attenuation device or muffler 24. While shown directly connecting internal combustion engine 14 and selectively tunable exhaust noise attenuation device 24, it should be understood that additional exhaust treatment components may be fluidically connected to exhaust gas conduit 19.

Figure 2:
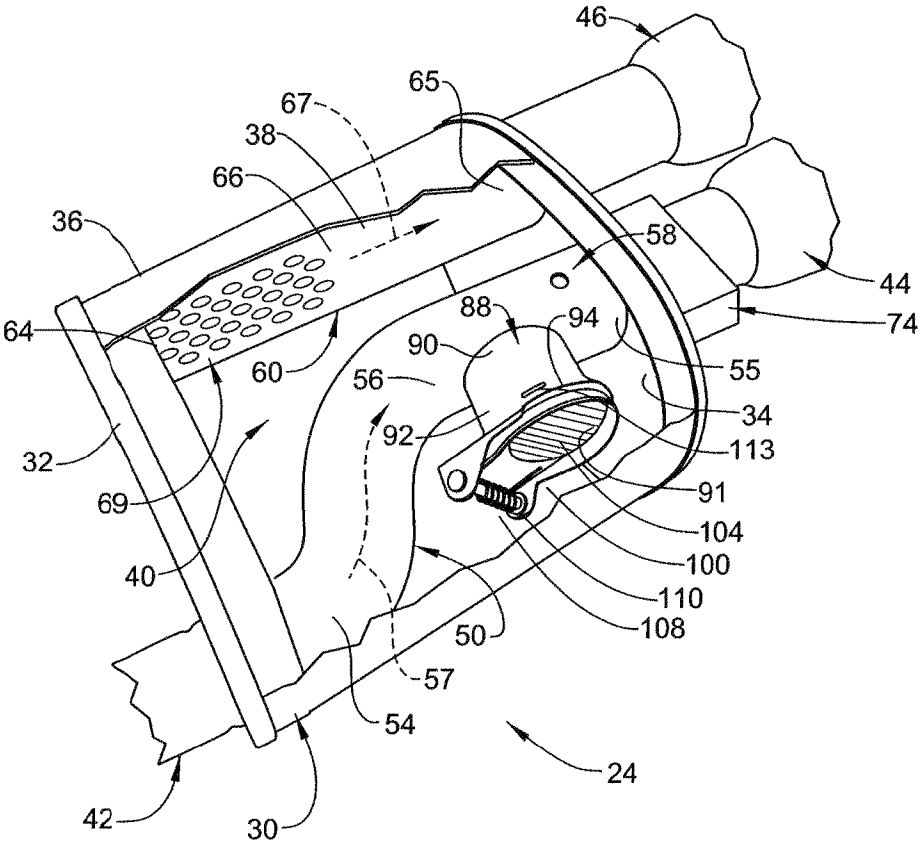
FIG. 2 is a partially disassembled view of the selectively tunable exhaust noise attenuation device of FIG. 1.

With reference to FIG. 2, selectively tunable exhaust noise attenuation device 24 includes a body 30 including a first wall 32, a second wall 34, an outer surface 36 and an inner surface 38 that defines an exhaust volume 40. Exhaust volume 40 may be filled with a sound absorbing material (not shown). Selectively tunable exhaust noise attenuation device 24 includes an inlet 42 fluidically connected to exhaust gas conduit 19, a first outlet 44 and a second outlet 46. A first conduit 50 extends within exhaust volume 40. First conduit 50 includes a first end 54 fluidically connected to inlet 42, a second end 55 fluidically connected to first outlet 44, and an intermediate portion 56 extending therebetween. First conduit 50 defines a primary exhaust flow path 57 for selectively tunable exhaust noise attenuation device 24. One or more openings 58 are formed in intermediate portion 56. Openings 58 include a predetermined diameter to control an amount of exhaust gas passing into exhaust volume 40 as will be detailed below.

Selectively tunable exhaust noise attenuation device 24 also includes a second conduit 60 having a first end section 64, a second end section 65 and an intermediate section 66 extending therebetween. First end section 64 may be coupled to first wall 32 and second end section 65 may be fluidically connected to second outlet 46. Second conduit 60 defines a secondary exhaust flow path 67 for selectively tunable exhaust noise attenuation device 24. A plurality of perforations, indicated generally at 69, is formed in intermediate section 66 fluidically connecting second conduit 60 and exhaust volume 40. At this point, it should be understood that the number, size and location of perforations 69 may vary. Perforations 69 provide a passage for exhaust gas in exhaust volume 40 to enter second conduit 60. It should be understood that in place of perforations, second conduit 60 may be provided with an inlet valve. A selectively controllable valve 74 is coupled to first outlet 44.

As will be discussed more fully below, selectively controllable valve 74 is arranged externally of body 30 and is selectively positioned to pass a desired amount of exhaust gas through first conduit 50. Selectively controllable valve 74 may also be positioned to create a back pressure forcing a desired amount of exhaust gas from primary exhaust flow path 57 through opening(s) 58 into exhaust volume 40. The exhaust gas in exhaust volume 40 may pass into second conduit 60 through perforations 69 and into secondary exhaust flow path 67 where it exits through second outlet 46. Exhaust gas passing through second outlet 46 exits with a desired amount of noise energy.

In accordance with an aspect of an exemplary embodiment, selectively tunable exhaust noise attenuation device 24 includes a branch conduit 88 extending radially outwardly from first conduit 50. Branch conduit 88 includes a first end portion 90 fluidically connected to first conduit 50, a second end portion 91 and an intermediate zone 92. Second end portion 91 defines a cantilevered end portion 94. A valve 100 is provided at cantilevered end portion 94 and laterally off-set of primary exhaust gas flow path. Valve 100 includes a valve member 104 selectively shiftable between a closed configuration and an open configuration. More specifically, valve 100 includes a biasing member 108 that biases valve member 104 toward the closed configuration. Biasing member 108 may take the form of a coil spring 110.

However, it should be noted that other types of biasing components may be employed to maintain valve member 104 in a desired configuration. In accordance with an aspect of an exemplary embodiment, one or more openings 113 are formed in branch conduit 88 upstream of valve 100.

Figure 3:
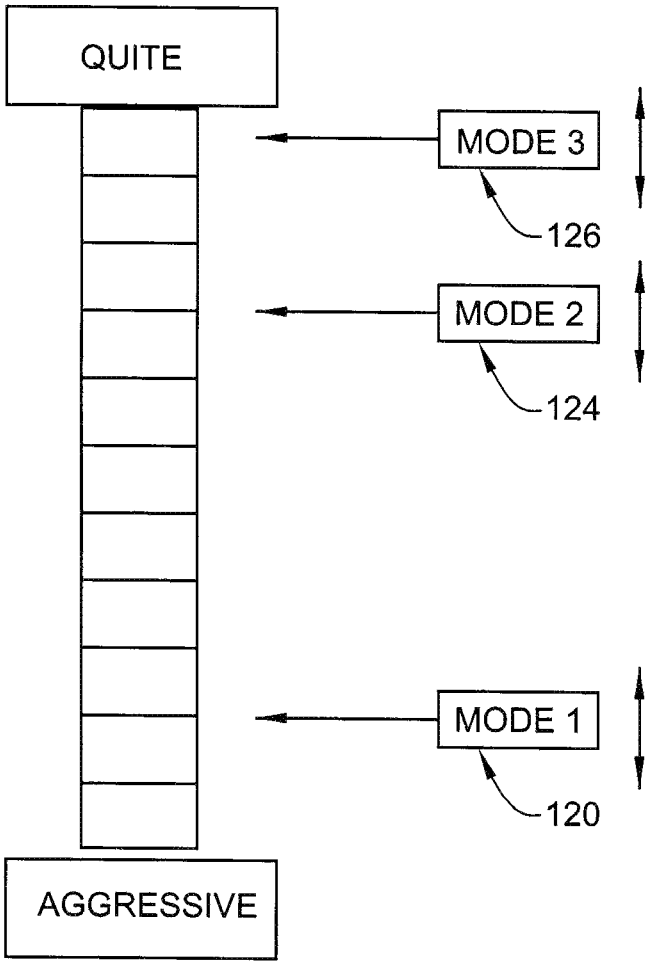
FIG. 3 is a chart illustrating various modes of operation of the selectively tunable exhaust noise attenuation device of FIG. 2.

In accordance with an aspect of an exemplary embodiment, selectively tunable exhaust noise attenuation device 24 may be operated in one or more modes depending upon a desired level of noise attenuation. In a first or track mode 120 illustrated in FIG. 3, selectively controllable valve 74 may be wide open allowing all exhaust gas to pass directly from first outlet 44. In a second or performance mode 124, selectively controllable valve 74 may be shifted towards a closed position. In performance mode 124, exhaust gas may exit both from first outlet 44 and from opening(s) 58 and pass into exhaust volume 40. The gases entering exhaust volume 40 pass through perforations 69 and into second conduit 60 and flow along secondary exhaust flow path 67 to exit from second outlet 46. Selectively tunable exhaust noise attenuation device 24 may also operate in a third or quiet mode 126. In quiet mode 126, selectively controllable valve 74 is shifted further towards the closed position, exhaust pressure in first conduit 50 and exhaust pressure in branch conduit 88 rise. Opening(s) 58 may no longer pass enough exhaust gas into exhaust volume 40. At a predetermined exhaust gas pressure, valve member 104 overcomes a biasing force applied by biasing member 108 and shifts toward the open configuration. Additional exhaust gas enter into exhaust volume 40, pass through perforations 69 into secondary exhaust flow path 67 to exit second outlet 46.

At this point it should be understood that the exemplary embodiments describe a selectively tunable exhaust noise attenuation device that may be operated in multiple modes. Further, the selectively tunable exhaust noise attenuation device includes a valve that is off-set from a primary exhaust flow. More specifically, the valve may be located in a branch conduit that extends off from the primary exhaust flow, or the valve may be located in the secondary exhaust flow path. It should also be understood that the valve may be located outside of the body or exhaust volume. Further, while described as including three modes of operation, it should be understood that additional modes may also be available. Further, while described as being a mechanical valve, the valve arranged within the exhaust volume may also be an electrically operated valve.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the invention not be limited to the particular embodiments disclosed, but will include all embodiments falling within the scope of the application.

What is claimed is:

1. A selectively tunable exhaust noise attenuation device comprising:

a body including an outer surface and an inner surface that defines an exhaust volume;

an inlet coupled to the body and fluidically connected to the exhaust volume;

a first outlet coupled to the body and fluidically connected to the inlet and selectively fluidically connected to the exhaust volume, and a second outlet coupled to the body and fluidically connected to the exhaust volume;

a first conduit including a primary exhaust gas flow path directly fluidically connecting the inlet and the first outlet;

a second conduit including a first end fluidically exposed to the exhaust volume, a second end fluidically connected to the second outlet, the second conduit defining a secondary exhaust gas flow path; and a valve fluidically connected to one of the first and second conduits and selectively fluidically connected to the exhaust volume, the valve being arranged laterally off-set of the primary exhaust gas flow path.

2. The selectively tunable exhaust noise attenuation device according to claim 1, further comprising: a branch conduit extending radially outwardly of the first conduit, the branch conduit including a cantilevered end portion, wherein the valve is arranged at the cantilevered end portion of the branch conduit within the exhaust volume.

3. The selectively tunable exhaust noise attenuation device according to claim 2, wherein the valve includes a valve member shiftable between a closed configuration and an open configuration, the valve member including a biasing member resiliently biasing the valve member in the closed configuration.

4. The selectively tunable exhaust noise attenuation device according to claim 3, wherein the biasing member releases at a predetermined exhaust gas pressure in the branch conduit allowing the valve member to shift toward the open configuration.

5. The selectively tunable exhaust noise attenuation device according to claim 3, wherein the biasing member comprises a coil spring.

6. The selectively tunable exhaust noise attenuation device according to claim 2, further comprising: an opening formed in the first conduit downstream of the branch conduit.

7. The selectively tunable exhaust noise attenuation device according to claim 2, further comprising: an opening formed in the branch conduit upstream of the valve.

8. The selectively tunable exhaust noise attenuation device according to claim 1, further comprising: a plurality of perforations formed in the second conduit.

9. The selectively tunable exhaust noise attenuation device according to claim 1, further comprising: a selectively controllable valve arranged on the first outlet externally of the body.

10. The selectively tunable exhaust noise attenuation device according to claim 1, wherein the valve is a mechanical valve.

11. A motor vehicle comprising:

a vehicle body;

an internal combustion engine arranged within the vehicle body; and a selectively tunable exhaust noise attenuation device fluidically connected to the internal combustion engine, the selectively tunable exhaust noise attenuation device comprising:

a body including an outer surface and an inner surface that defines an exhaust volume;

an inlet coupled to the body and fluidically connected to the exhaust volume and the internal combustion engine;

a first outlet coupled to the body and fluidically connected to the exhaust volume, and a second outlet coupled to the body and fluidically connected to the exhaust volume;

a first conduit including a primary exhaust gas flow path directly fluidically connecting the inlet and the first outlet;

a second conduit including a first end fluidically exposed to the exhaust volume, a second end fluidically connected to the second outlet, the second conduit including a secondary exhaust gas flow path; and a valve fluidically connected to one of the first and second conduits and selectively fluidically connected to the exhaust volume, the valve being arranged laterally off-set of the corresponding one of the primary and secondary exhaust gas flow paths.

12. The motor vehicle according to claim 11, further comprising: a branch conduit extending radially outwardly of the first conduit, the branch conduit including a cantilevered end portion, wherein the valve is arranged at the cantilevered end portion of the branch conduit within the exhaust volume.

13. The motor vehicle according to claim 12, wherein the valve includes a valve member shiftable between a closed configuration and an open configuration, the valve member including a biasing member resiliently biasing the valve member in the closed configuration.

14. The motor vehicle according to claim 13, wherein the biasing member releases at a predetermined exhaust gas pressure in the branch conduit allowing the valve member to shift toward the open configuration.

15. The motor vehicle according to claim 13, wherein the biasing member comprises a coil spring.

16. The motor vehicle according to claim 12, further comprising: an opening formed in the first conduit downstream of the branch conduit.

17. The motor vehicle according to claim 12, further comprising: an opening formed in the branch conduit upstream of the valve.

18. The motor vehicle according to claim 11, further comprising: a plurality of perforations formed in the second conduit.

19. The motor vehicle according to claim 11, further comprising: a selectively controllable valve arranged on the first outlet externally of the body.

20. A method of operating a selectively tunable exhaust noise attenuation device comprising:

delivering exhaust gas into a body of the selectively tunable exhaust noise attenuation device;

operating the selectively tunable exhaust noise attenuation device in a first mode in which all of the exhaust gas pass through a first conduit uninterrupted through the body;

operating the selectively tunable exhaust noise attenuation device in a second mode in which a portion of the exhaust gas pass from a first opening in the first conduit into the body and enter a second opening of a second conduit; and operating the selectively tunable exhaust noise attenuation device in a third mode, in which a portion of the exhaust gas pass through a valve off-set from the first conduit into the body and through the second opening into the second conduit.

* * * * *